US010694914B2

(12) United States Patent
McGee et al.

(10) Patent No.: US 10,694,914 B2
(45) Date of Patent: Jun. 30, 2020

(54) STEAM APPLIANCE

(75) Inventors: Brian R. McGee, Hong Kong (CN); Stuart D. Babb, Milton, MA (US)

(73) Assignee: SharkNinja Operating LLC, Needham, MA (US)

( * ) Notice: Subject to any disclaimer, the term of this patent is extended or adjusted under 35 U.S.C. 154(b) by 755 days.

(21) Appl. No.: 13/261,702

(22) PCT Filed: Jan. 31, 2012

(86) PCT No.: PCT/US2012/023366
§ 371 (c)(1),
(2), (4) Date: Jan. 24, 2014

(87) PCT Pub. No.: WO2012/106359
PCT Pub. Date: Aug. 9, 2012

(65) Prior Publication Data

US 2014/0150201 A1 Jun. 5, 2014

Related U.S. Application Data

(60) Provisional application No. 61/439,023, filed on Feb. 3, 2011.

(51) Int. Cl.
*A47L 11/40* (2006.01)
*A47L 13/22* (2006.01)
*A47L 13/254* (2006.01)

(52) U.S. Cl.
CPC ..... *A47L 11/4086* (2013.01); *A47L 13/225* (2013.01); *A47L 13/254* (2013.01)

(58) Field of Classification Search
CPC .... A47L 13/22; A47L 13/225; A47L 11/4086; F22B 1/285
See application file for complete search history.

(56) References Cited

U.S. PATENT DOCUMENTS 5,386,612 A 2/1995 Sham et al.
5,819,364 A 10/1998 Sham et al.
(Continued)

FOREIGN PATENT DOCUMENTS

CN 2525928 Y 12/2002
CN 201337414 Y 11/2009
(Continued)

OTHER PUBLICATIONS

Content of web page at: http://www.thane.com/products/housewares/h2omopultra/h2omopultra.php Date: Jul. 28, 2010.
(Continued)

*Primary Examiner* — Bryan R Muller
*Assistant Examiner* — Joel D Crandall
(74) *Attorney, Agent, or Firm* — Grossman Tucker Perreault & Pfleger, PLLC

(57) ABSTRACT

An appliance includes a steam application device having a main body which includes an inlet section to receive steam, an applicator to apply the steam to a surface, and a swivel assembly to swivel the applicator and the main body relative to each other. The appliance further includes a portable steamer to (i) attach to the steam application device and (ii) detach from the steam application device (e.g., in a simple lift away manner). The portable steamer has a steam generator which generates the steam, and an outlet section which connects to the inlet section of the main body of the steam application device when the portable steamer is attached to the steam application device. The outlet section provides the steam from the steam generator to the inlet section of the main body of the steam application device when the portable steamer is attached to the steam application device.

17 Claims, 10 Drawing Sheets

(56) References Cited

U.S. PATENT DOCUMENTS

| | | | | |
|---|---|---|---|---|
| 6,101,671 | A | 8/2000 | Wright et al. | |
| 6,490,753 | B1 | 12/2002 | Chen | |
| 6,571,421 | B1 † | 6/2003 | Sham | |
| 6,839,934 | B2 | 1/2005 | Houghton et al. | |
| 7,048,804 | B2 † | 5/2006 | Kisela | |
| 7,380,307 | B2 | 6/2008 | Tsai | |
| 7,516,565 | B1 † | 4/2009 | Tsen | |
| 7,930,798 | B2 | 4/2011 | Zhou et al. | |
| 8,534,301 | B2 † | 9/2013 | Nottingham | |
| 2002/0194693 | A1 * | 12/2002 | Wu | A47L 9/242 15/322 |
| 2003/0089383 | A1 | 5/2003 | Biggs et al. | |
| 2003/0159228 | A1 * | 8/2003 | Lee | A47L 7/009 15/246.2 |
| 2003/0233727 | A1 * | 12/2003 | Wheeler | A47L 5/24 15/320 |
| 2004/0134016 | A1 * | 7/2004 | Kisela | A47L 5/24 15/320 |
| 2005/0236012 | A1 | 10/2005 | Josefsson et al. | |
| 2006/0081589 | A1 * | 4/2006 | Chi-Ting | D06F 75/265 219/248 |
| 2006/0168755 | A1 | 8/2006 | Langerak | |
| 2007/0169304 | A1 * | 7/2007 | Tsai | A47L 11/34 15/320 |
| 2009/0279938 | A1 | 11/2009 | Rosenzweig et al. | |
| 2009/0320231 | A1 | 12/2009 | Rosenzweig et al. | |
| 2010/0050367 | A1 | 3/2010 | Tsai | |
| 2010/0116298 | A1 * | 5/2010 | Rosenzweig | A47L 13/22 134/105 |
| 2010/0126533 | A1 * | 5/2010 | Nottingham | A47L 13/22 134/105 |
| 2010/0186463 | A1 | 7/2010 | Vrdoljak et al. | |
| 2010/0212098 | A1 | 8/2010 | Vrdoljak | |
| 2010/0251505 | A1 * | 10/2010 | Vrdoljak | A47L 9/0686 15/320 |
| 2010/0269287 | A1 | 10/2010 | Vrdoljak | |
| 2010/0272948 | A1 | 10/2010 | Kaminer et al. | |
| 2010/0319156 | A1 | 12/2010 | Hsu | |
| 2014/0150201 | A1 | 6/2014 | McGee et al. | |

FOREIGN PATENT DOCUMENTS

| | | |
|---|---|---|
| CN | 201482748 U | 5/2010 |
| JP | 3150459 | 5/2009 |
| KR | 10-2008-0053667 | 6/2008 |
| KR | 10-2008-0053671 | 6/2008 |
| WO | WO 2009/148911 | 12/2009 |
| WO | WO 2011/019814 A2 † | 2/2011 |

OTHER PUBLICATIONS

Content of web page at: http://www.gruensteam.com/ItemDetail.aspx Copyright Date: 2009.

Office Action from Canadian Application No. 2,826,402 dated Jul. 8, 2014.

Office Action from Korean Application No. 10-2013-7023331 dated Oct. 29, 2014. (English Translation).

Office Action from New Zealand Application No. 613935 dated Mar. 5, 2014.

Office Action from United Kingdom Application No. GB1313830.0 dated Sep. 26, 2014.

Written Opinion of the International Searching Authority (Korea) dated Sep. 7, 2012 (five (5) pages).

Office Action and Search Report from Chinese Patent Application No. 201280013124.2 dated Jun. 30, 2015.

Thane International, Inc., User's Guide for H2O Mop Ultra TM, Oct. 14, 2009.

Office Action dated Sep. 9, 2016 in corresponding Australian patent application No. 2015271987.

Chinese Office Action/Search Report with English language translation dated Apr. 3, 2018, received in corresponding Chinese Patent Application No. 201610228494.8, 23 pgs.

Chinese Office Action with English translation dated Dec. 13, 2018, received in Chinese Application No. 201610228494.8, 9 pgs.

Canadian Office Action dated Dec. 4, 2018, received in Canadian Application No. 2,925,496, 4 pgs.

* cited by examiner
† cited by third party

STEAM APPLIANCE

CROSS REFERENCE TO RELATED APPLICATIONS

This application is a national stage application, filed under 35 U.S.C. § 371, of International Patent Application No. PCT/US2012/023366, filed on Jan. 31, 2012, international Patent Application No. PCT/US2012/023366 claims the benefit under 35 U.S.C. § 119(e) of U.S. Provisional Application Ser. No. 61/439,023 entitled "STEAM MOP," filed on Feb. 3, 2011. The contents and teachings of U.S. provisional application Ser. No. 61/439,023 are hereby incorporated by reference in their entirety.

BACKGROUND

A conventional steam mop includes a mop housing having a mop handle at one end and a steal frame at an opposite end. The mop housing contains a water tank, an electric pump, and a boiler. The steal frame is covered by a fabric steam pocket made of fabric material.

During operation, an operator fills the water tank within the mop housing with water and turns on the steam mop. The electric pump within the mop housing delivers water from the water tank to the boiler, and the boiler within the mop housing converts the water into steam for application at the steal frame. The fabric steam pocket covering the steal frame is then capable of steam mopping a floor in response to the operator pushing and pulling the steam mop over the floor.

SUMMARY

An improved steam appliance includes (i) a steam application device (e.g., a mop) which is equipped with a swivel to provide enhanced maneuverability, and (ii) a portable steam source (or steamer) which provides steam for use by the steam application device as well as for use independently of the steam application device (e.g., in a standalone manner). With such a combination, a user is able to conveniently and effectively clean a variety of surfaces with the portable steamer attached to the steam application device (e.g., tile floors, linoleum, hardwood flooring, etc.) as well as other surfaces with the portable steamer detached from the steam application device (e.g., counter tops, walls, etc.).

One embodiment is directed to an appliance which includes a steam application device having a main body which includes an inlet section to receive steam, an applicator constructed and arranged to apply the steam to a surface, and a swivel assembly constructed and arranged to swivel the applicator and the main body relative to each other. The appliance further includes a portable steamer constructed and arranged to (i) attach to the steam application device and (ii) detach from the steam application device (e.g., in a simple lift away manner). The portable steamer has a steam generator constructed and arranged to generate the steam, and an outlet section constructed and arranged to connect to the inlet section of the main body of the steam application device when the portable steamer is attached to the steam application device. The outlet section is constructed and arranged to provide the steam from the steam generator to the inlet section of the main body of the steam application device when the portable steamer is attached to the steam application device.

In some arrangements, the steam application device forms an entire swivel mop independently of the portable steamer. As such, the portable steamer does not need to bear any mopping load (e.g., mopping force applied by the user). In these arrangements, the main body of the steam application device is constructed and arranged to cradle the portable steamer within a cavity when the portable steamer attaches to the steam application device. As a result, an outlet section of the portable steamer is able to form a robust and reliable connection with an inlet section of the main body of the steam application device.

In some arrangements, the cavity defined by the main body of the steam application device is a C-shaped opening, and a center axis of the swivel mop passes through the cavity. Nevertheless, the main body bears the mopping forces provided by the user thus alleviating the need to expose the portable steamer to mopping forces that could otherwise prematurely fatigue the portable steamer or could otherwise interfere with the steam connection between the portable steamer and the steam application device. Moreover, such modularization of the steam source enables the user to easily detach the portable steamer from the steam application device and use the portable steamer independently (e.g., to clean a counter surface).

Other embodiments are directed to steam appliance systems, assemblies, devices, accessories, combinations thereof, etc. Some embodiments are directed to various methods which are involved in making and/or operating a steam appliance.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

An improved steam appliance includes a steam application device (e.g., a mop) which is equipped with a swivel to provide enhanced maneuverability, and a portable steam source (or steamer) which provides steam for use by the steam application device as well as for use independently of the steam application device. In particular, particular, when the portable steamer attaches to the steam application device, a user is able to conveniently and effectively clean a variety of surfaces (e.g., utilize swivel action provided by the steam application device to clean tile floors, linoleum, hardwood flooring, etc.). Additionally, when the portable steamer is detached from the steam application device, the user is able to carry the portable steamer in a handheld manner to clean other surfaces (e.g., counter tops, walls, furniture, etc.).

Figure 1:
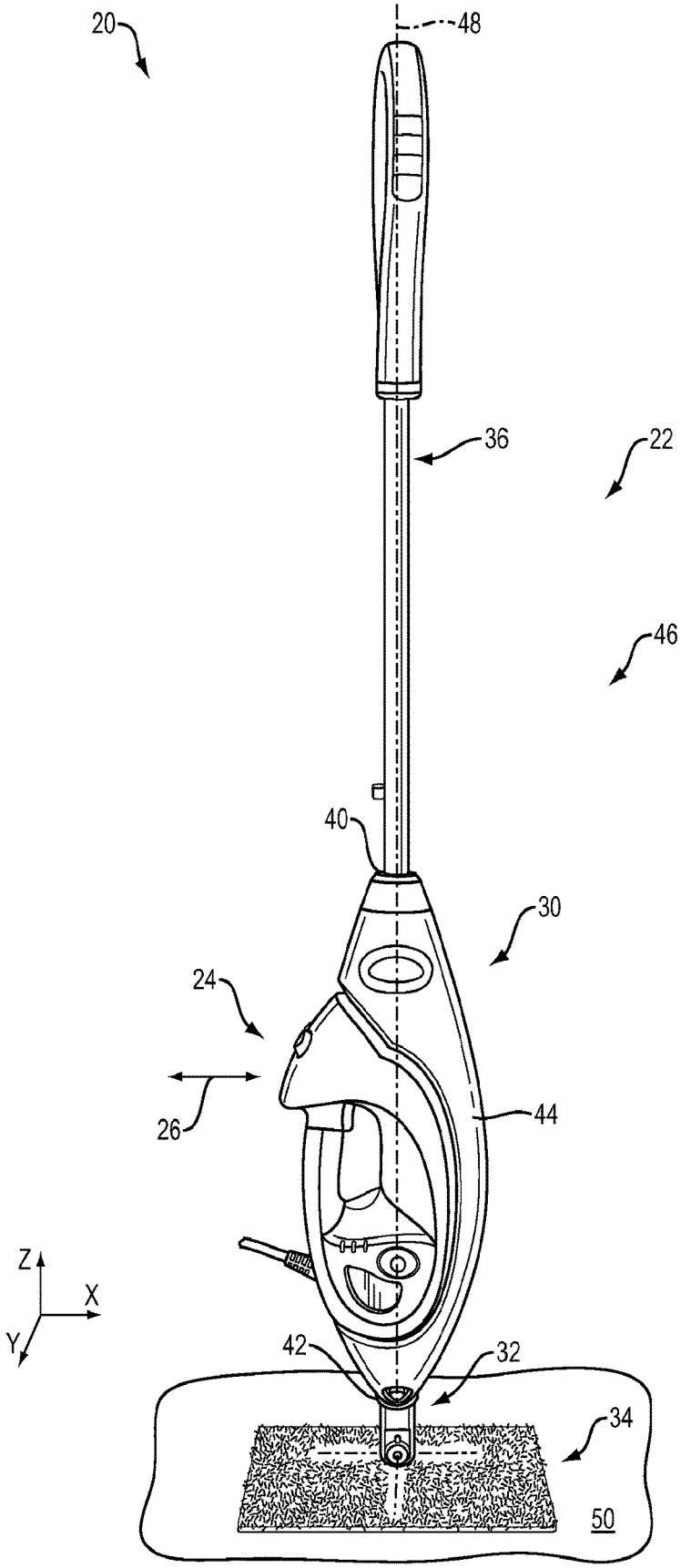
FIG. 1 is a front view of an appliance having (i) a steam application device equipped with a swivel to provide enhanced maneuverability, and (ii) a portable steam source.

FIG. 1 shows an appliance 20 having enhanced swivel and modularized features. In particular, the appliance 20 includes a steam application device 22 and a portable steamer 24. The portable steamer 24 is constructed and arranged to conveniently attach to the steam application device 22 and detach from the steam application device 22 (e.g., illustrated by the arrow 26).

Figure 2:
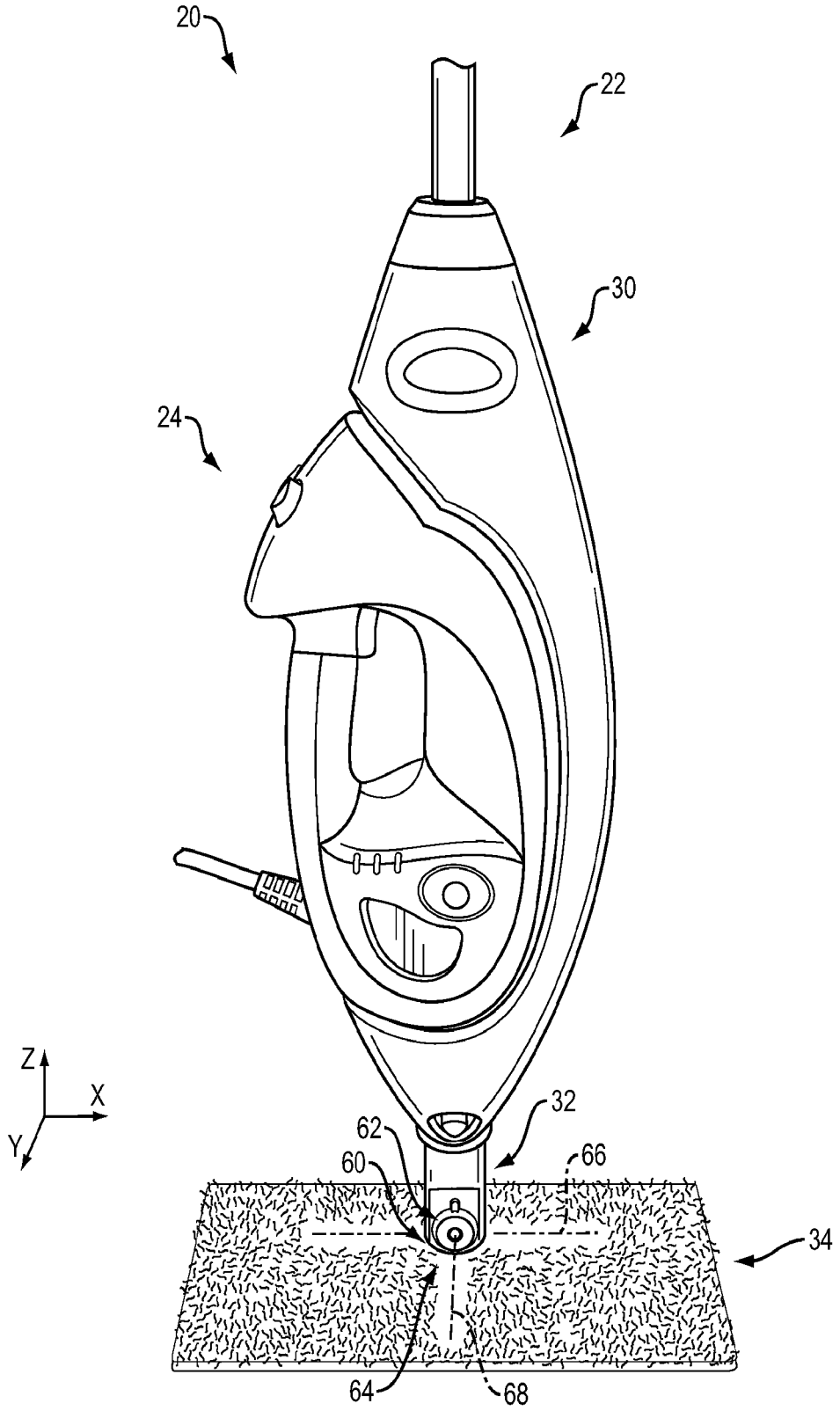
FIG. 2 is a close-up view of a portion of the appliance of FIG. 1.
Figure 3:
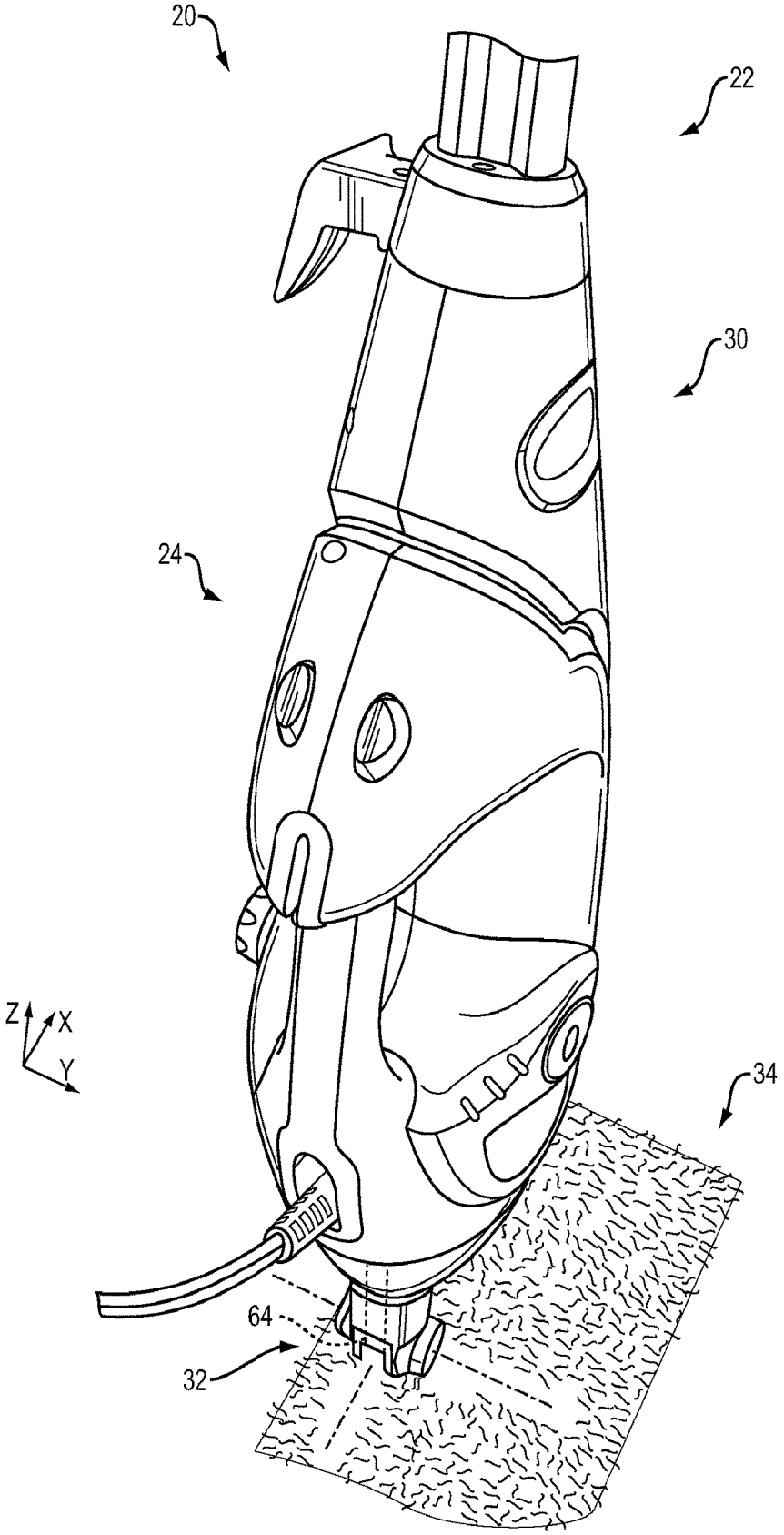
FIG. 3 is another close-up view of the portion of the appliance of FIG. 1 but from another angle.
Figure 4:
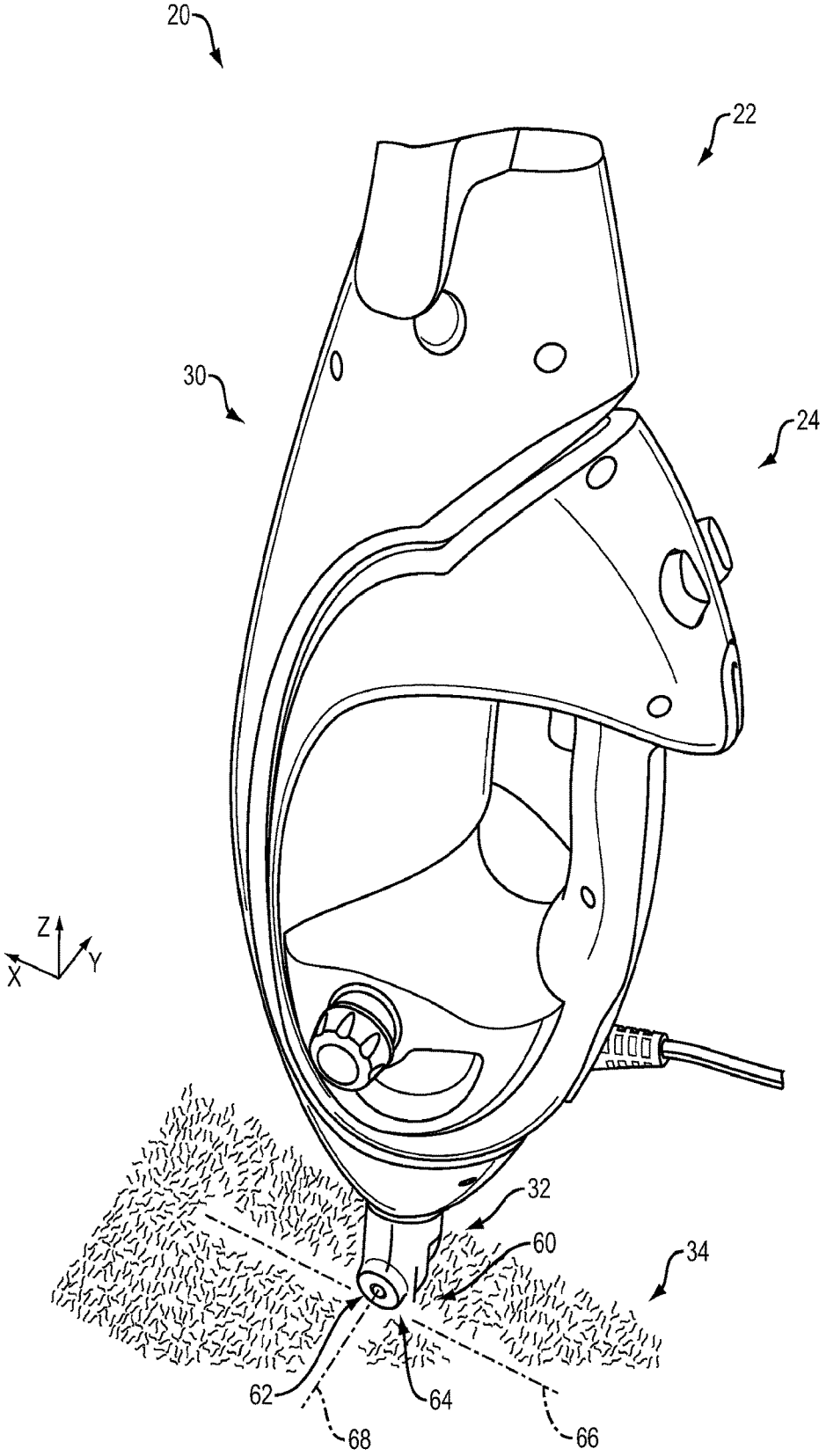
FIG. 4 is yet another close-up view of the portion of the appliance of FIG. 1 from a different angle.
Figure 5:
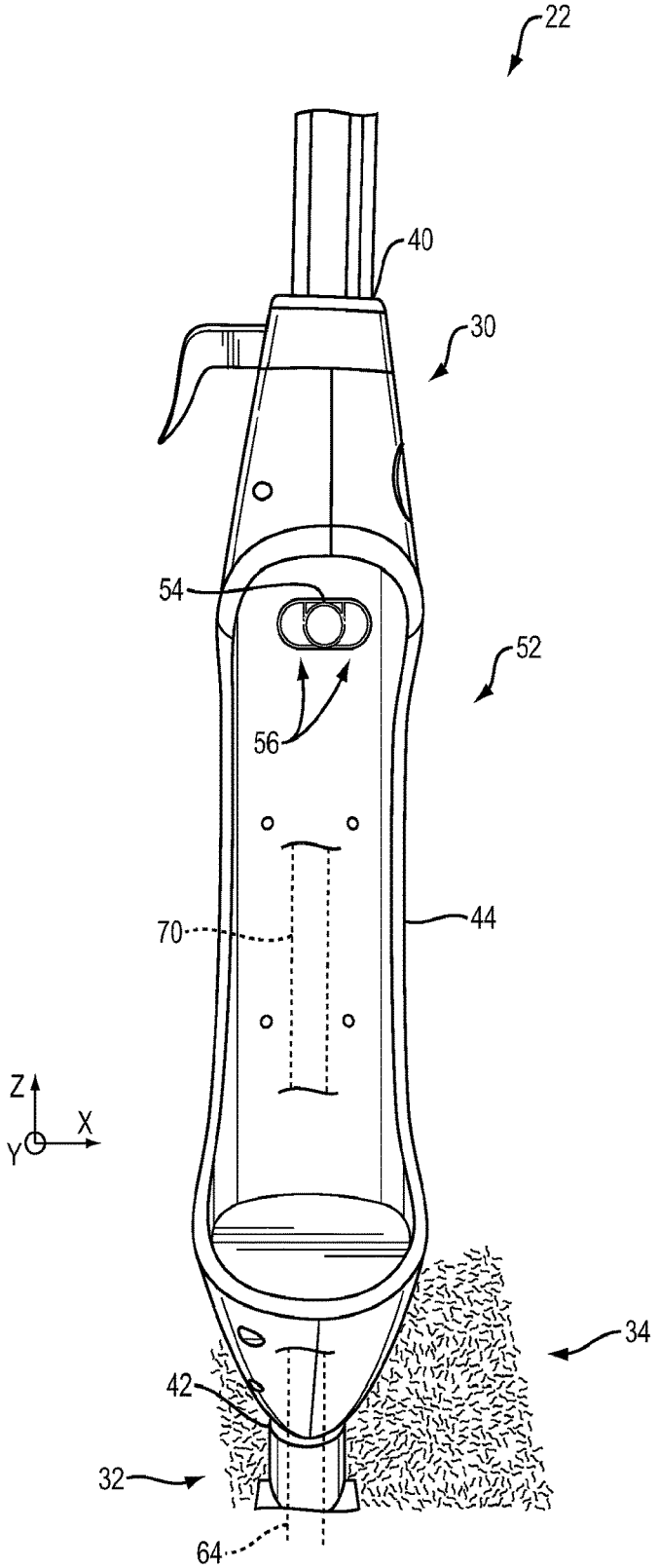
FIG. 5 is a view of a portion of the appliance when the portable steam source is removed.
Figure 6:
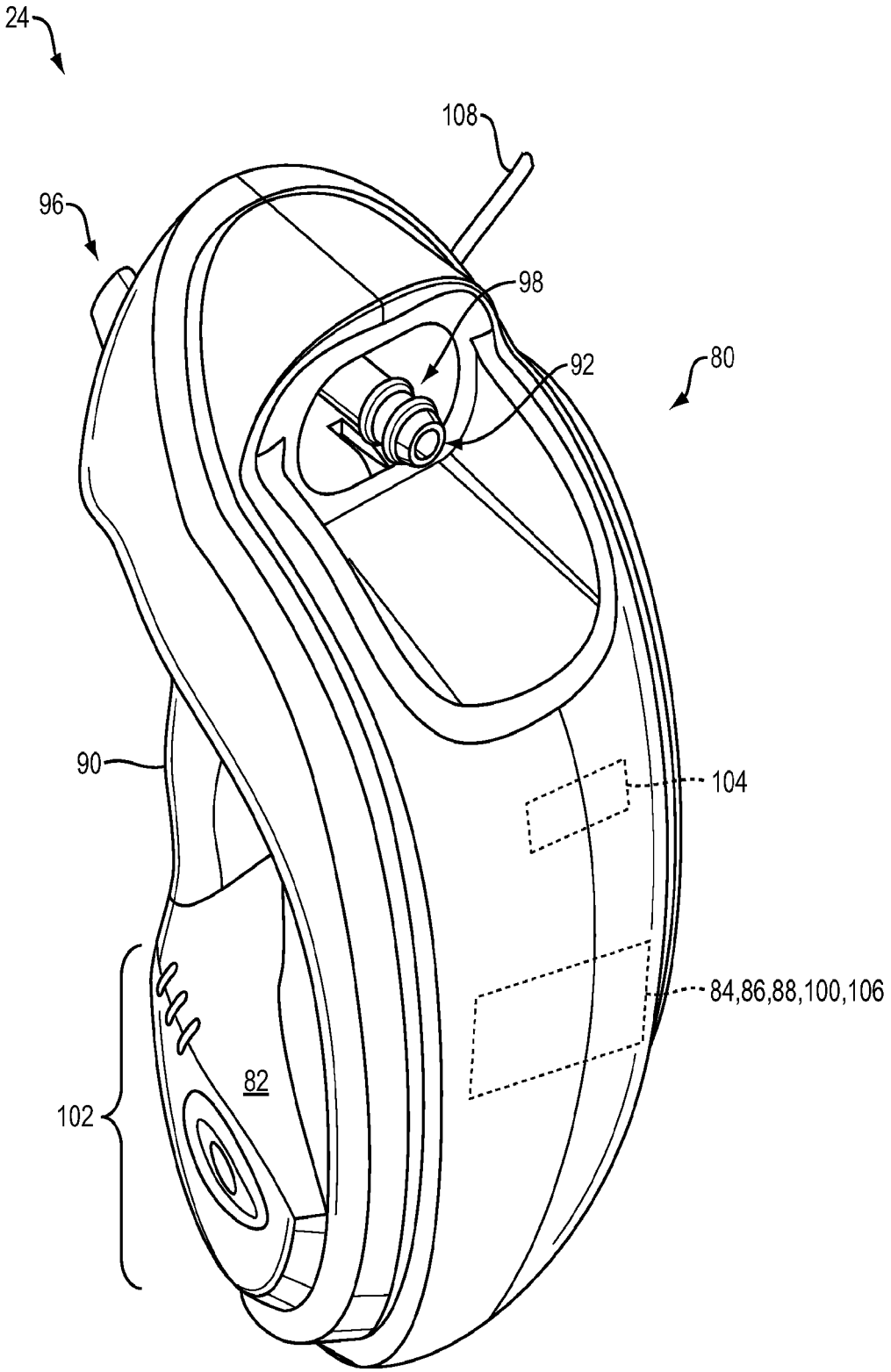
FIG. 6 is a detailed view of the portable steam source.
Figure 7:
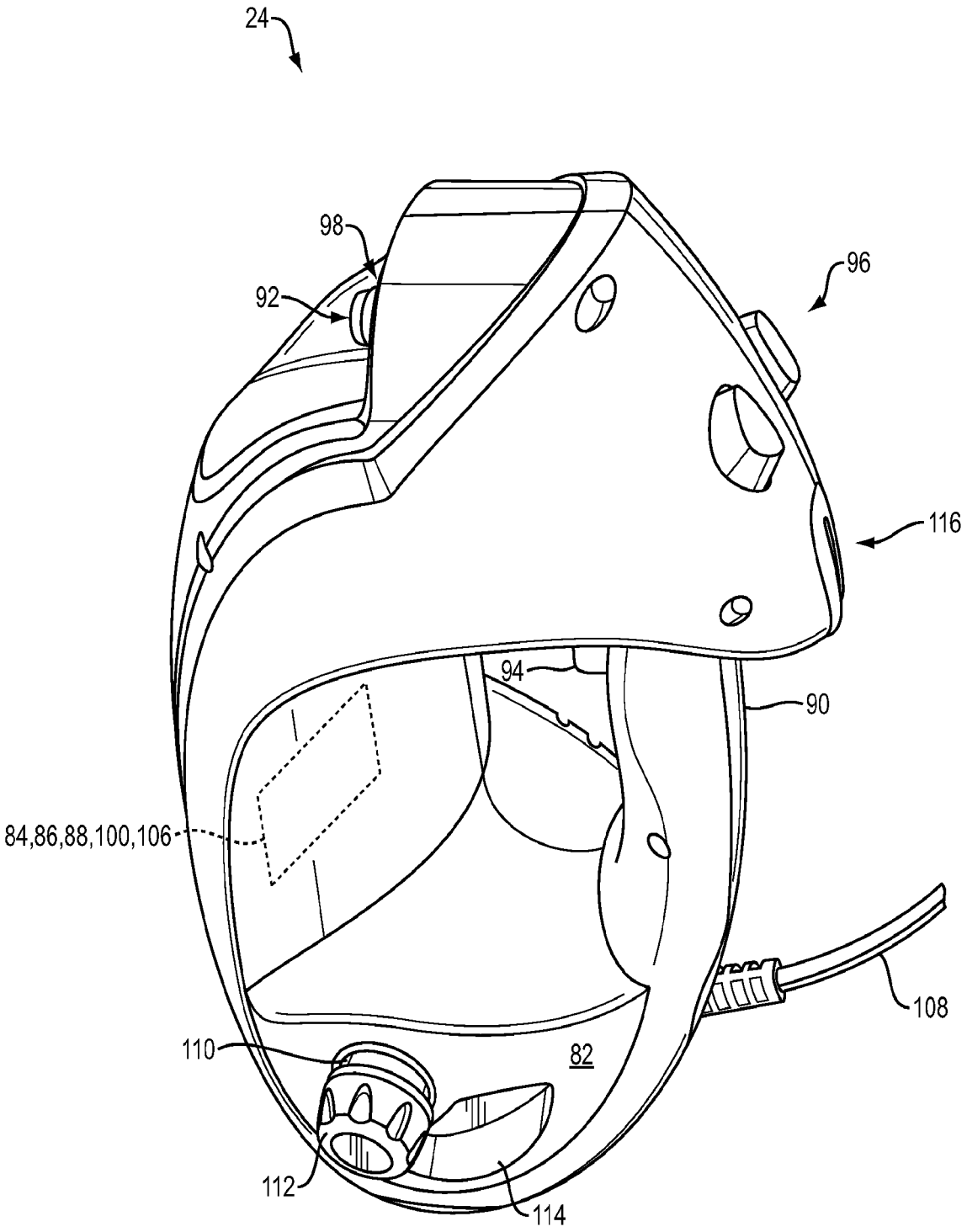
FIG. 7 is a detailed view of the portable steam source from another angle.

FIGS. 2-7 provide additional viewing angles of various portions of the appliance 20. In particular, FIGS. 2-4 provide additional views of a lower portion of the appliance 20. Additionally, FIG. 5 shows particular details of the steam application device 22 when the portable steamer 24 is removed. Furthermore, FIGS. 6-7 show particular details of the portable steamer 24.

The steam application device 22 includes a main body 30, a swivel assembly 32, an applicator 34, and a mop handle 36 (see FIGS. 1-5). The main body 30 includes a first end 40 which connects directly to the mop handle 36, a second end 42 which connects directly to the swivel assembly 32, and a mid-portion 44 disposed between the first and second ends 40, 42. The swivel assembly 32 connects the main body 30 to the applicator 34, and operates in the manner of a universal joint to allow the main body 30 and the applicator 34 to swivel relative to each other. As best seen in FIG. 1, the mop handle 36, the main body 30, the swivel assembly 32 and the applicator 34 are disposed in a sturdy inline configuration which forms a mop 46 having a central axis 48. In this configuration, a user, when maneuvering the mop handle 36, is able to effectively and conveniently clean a surface 50 with the applicator 34. A variety of steam mop functionalities which are suitable for the mop 46 are disclosed for a similar mop in U.S. patent application Ser. No. 12/163,537 filed on Jun. 27, 2008 and published as U.S. Patent Application No. 2009/0320231 on Dec. 31, 2009, the contents and teachings of which are incorporated by reference in their entirety.

It should be understood that the main body 30 is substantially C-shaped (e.g., see FIG. 2) and defines a cavity 52 (e.g., see FIG. 5) to hold the portable steamer 24. As best seen in FIG. 5, the mid-portion 44 of the main body 30 includes an inlet section 54 to receive steam, and a set of tabs 56 which enable the portable steamer 24 to lock into place within the cavity 52. With this C-shaped geometry, the main body 30 cradles the portable steamer 24 in a manner that robustly and reliably supports the portable steamer 24 when the portable steamer 24 is attached to the main body 30 and connects with the inlet section 54. Additionally, the inlet section 54 and the set of tabs 56 are positioned within the recess of the C-shaped geometry to protect them against damage when the portable steamer 24 is detached from the main body 30 (e.g., to avoid collecting dust and dirt on these features which could otherwise interfere with their operation, to prevent physical damage, etc.).

In some arrangements, the central axis 48 of the mop 46 passes through the cavity 52 (FIG. 1), but the construction of the main body 30 nevertheless provides sufficient support strength to maintain sturdiness of the mop 46 and thus enable the user to apply significant mopping force to the surface 50 for effective cleaning. Furthermore, such geometry enables the portable steamer 24 to have a relatively large, but modular form factor as well as enables the portable steamer 24 to detach from the steam application device 22 in a simple lift away manner, and attach to the steam application device 22 in a simple insertion manner.

The swivel assembly 32 connects the applicator 34 to the second end 42 of the main body 30. As best seen in FIGS. 2 and 4, the swivel assembly 32 includes a first set of hinges 60, a second set of hinges 62, and a flexible steam pathway 64 (illustrated by the dashed lines in FIG. 3). The first set of hinges 60 is disposed adjacent the applicator 34, and enables the main body 30 to pivot relative to the applicator 34 along an axis 66 in the X-direction. Such operation allows the applicator 34 to stay flush with the surface 50 even though the user changes the height of the mop handle 36 as the user moves the mop 46 forward and backward to mop the surface 50. The second set of hinges 62 is disposed above the first set of hinges 60 and closer to the main body 30, and enables the applicator 34 to rotate in a side-to-side manner about an axis 68 (i.e., left and right angular deflection). Accordingly, this combination of perpendicular hinges 60, 62 arranged in the manner of a universal connector (i.e., hinge pairs 60, 62 which are close together and oriented at 90 degrees to each other) enables the applicator 34 to simultaneously move side-to-side as well as remain flush on the surface 50 for enhanced mopping action while the user maneuvers the mop 46. A similar type of universal connector, which is suitable for use as the swivel assembly 32, is described in U.S. patent application Ser. No. 12/118,015 filed May 9, 2008 and published as U.S. Patent Application No. 2009/0279938 on Nov. 12, 2009, the contents and teachings of which are incorporated by reference in their entirety.

The flexible steam pathway 64 of the swivel assembly 32 (FIGS. 3 and 5) provides a steam channel from the main body 30 to the applicator 34. Along these lines, it should be understood that a channel 70 within the main body 30 leads from the inlet section 54 to an outlet at the end 42 (see FIG. 5), and the flexible steam pathway 64 of the swivel assembly 32 extends this channel 70 to the applicator 34. Accordingly, steam reliably passes from the inlet section 54 to the applicator 34 through the channel 70 for use in mopping the surface 50.

The applicator 34 includes a frame and a washable pad (or pocket) of suitable mop material (e.g., steam permeable fabric) which covers the frame. Steam conveyed through the flexible steam pathway 64 to the applicator 34 is thus effectively distributed to the surface 50 by the applicator 34 for effective steam mopping. In some arrangements, the first set of hinges 60 of the swivel assembly 32 are disposed substantially within the frame (i.e., embedded within the mop material). A similar steam pocket and associated frame is disclosed in U.S. patent application Ser. No. 12/467,057 filed May 15, 2009 and published as U.S. Patent Application No. 2010/0272948 on Oct. 28, 2010, the contents and teachings of which are incorporated by reference in their entirety.

The portable steamer 24 has a portable steamer housing 80, a tank 82, a mechanical pump 84, a steam generator 86, and electronic circuitry 88 (e.g., see FIGS. 6-7). The portable steamer housing 80 includes a portable steamer handle 90, an outlet section 92, a trigger 94, a set of depressible buttons 96, and a set of catches 98. The electronic circuitry 88 includes a controller 100, a user interface 102, a sensor 104, a vibration detector 106, and an electrical cord 108.

To attach the portable steamer 24 to the steam application device 22, the user picks up the portable steamer 24 by the portable steamer handle 90 and inserts the portable steamer 24 into the cavity 52 with the outlet section 92 of the portable steamer housing 80 (FIG. 6) facing the inlet section 54 of the main body 30 (FIG. 5) of the steam application device 22 (also see arrow 26 in FIG. 1). As the portable steamer 24 enters the cavity 54, the outlet section 92 engages with the inlet section 54 to form a tight connection through which steam is able to pass, and the set of catches 98 which are disposed around the outlet section 92 (FIG. 6) latch to the set of tabs 56 which are disposed around the inlet section 54. As a result, the portable steamer 24 is held securely within the cavity 52 of the main body 30, and the outlet section 92 and the inlet section 54 are tightly mated.

To unlock the portable steamer 24 from the cavity 52 of the main body 30, the user depresses one or more of the set of depressible buttons 96 (FIG. 6). In response, the set of catches 98 unlatch from the set of tabs 56 around the inlet section 54. While holding the portable steamer handle 90, the user is then able to disengage the outlet section 92 from the inlet section 54 and remove the portable steamer 24 from the cavity 52 in a simple lift away manner.

It should be understood that the set of depressible buttons 96 linked with the set of catches 98 forms a reliable actuable mechanism. Not only can this actuable mechanism control attachment and detachment relative to the steam appliance device 22, this actuable mechanism may also control attachment and detachment of other accessories and attachments to the portable steamer 24.

To operate the appliance 20 using steam, a user fills the tank 82 with water through an opening 110 (see FIGS. 3 and 7). The tank 82 is provisioned with a screw cap 112 to prevent the water in the tank 82 from escaping back through opening 110 once the user finishes filling the tank 82. The tank 82 is further provisioned with a window 114 (located just below the opening 110) to enable the user to identify a water level within the tank 82.

Next, the user plugs the electrical cord 108 into an electric outlet. Portions of the electric cord 108 may be secured or captured by a slot 116 defined by the portable steamer housing 80 (see FIG. 3). Moreover, in some arrangements, using the electrical cord 108 is optional, and power can be provided to the portable steamer 24 from batteries situated in the portable steamer housing 80.

The user then turns on the portable steamer 24 and sets the pump 84 to operate at a particular pump rate (e.g., low, medium, high, etc.). To this end, the electronic circuitry 88 provides a variable steam function, and the user provides user input through the user interface 102 to the controller 100 to identify a particular steam setting. In response, the controller 100 provides power to the steam generator 86 and directs the pump 84 to pump water from the tank 82 to the steam generator 86 at the selected pump rate.

In some arrangements, the user interface 102 includes a single push button as a control input, and a series of light emitting diodes (LEDs) to provide visual output. In these arrangements, the user simply presses the push button to toggle the pump 84 through different pump rates in a cyclical manner (e.g., via multiple button presses) and until the LEDs visually indicate a desired pump rate (e.g., via different lighted output). Other types of controls (e.g., knobs, multiple buttons, switches, etc.) and other types of light indicators (e.g., LCDs, pixilated displays, etc.) are suitable for use as well.

In response to the user input, the pump 84 delivers water from the tank 82 to the steam generator 86. The rate of water delivery depends on the pump rate setting provided by the user through the user interface 102.

At this point, it should be understood that the portable steamer 24 operates in an attached mode when the portable steamer 24 is attached to the steam application device 22, and an unattached mode as a standalone steamer when the portable steamer 24 is detached from the steam application device 22. The portable steamer 24 is capable of detecting whether the portable steamer 24 is attached to the steam application device 22 via the sensor 104. In particular, the sensor 104 outputs an electronic signal having a first value (e.g., a high voltage) when the portable steamer 24 is attached to the steam application device 22, and a second value (e.g., a low voltage or zero volts) when the portable steamer 24 is detached from the steam application device 22. The controller 100 receives this electronic signal and operates in the appropriate mode.

In some arrangements, the sensor 104 is a contactless sensing component such as a Hall Effect sensor or magnetic switch which can detect a magnetic field or a change in magnetic field strength from a magnetic source on the steam application device 22. Such arrangements alleviate the need for electrical continuity between the portable steamer 24 and the steam application device 22.

When the portable steamer 24 is attached to the steam application device 22 and runs in the attached mode, the trigger 94 is disabled. Accordingly, there is no change in operation if the user squeezes the trigger 94 while the portable steamer 24 is attached to the steam application device 22. Rather, the portable steamer 24 ignores operation of the trigger 94 and simply releases steam generated by the steam generator 86 to the inlet section 54 (FIG. 5) to deliver steam to the applicator 34. Along these lines, as the steam generator 86 receives water from the pump 84 and converts that water into steam, the steam is immediately discharged through the outlet section 92 to the inlet section 54 of the steam application device 22.

However, when the portable steamer 24 is detached from the steam application device 22 and runs in the unattached mode, the trigger 94 is enabled. Here, the user squeezes the trigger 94 to release steam through the outlet section 92. Accordingly, while the portable steamer 24 runs in the unattached mode, the user is capable of holding the portable steamer handle 90 in one hand with a finger of that hand on the trigger 94 to control steam release. When the user's finger actuates the trigger 94, steam under pressure exits the outlet section 92 (FIG. 6). The user is then able to apply that steam directly to a surface or perhaps through an attachment or extension (e.g., held by the user's other hand) to deliver steam more precisely to a surface for cleaning and/or steam treatment (e.g., disinfecting).

A variety of steam accessories including the likes of steam applicators, conduits and attachments which are suitable for use are disclosed in U.S. patent application Ser. No. 12/554,477 filed Sep. 4, 2009 and published as U.S. Patent Application No. 2010/0212098 on Aug. 26, 2010, the contents and teachings of which are incorporated by reference in their entirety. Similarly, other steam accessories which are suitable for use are disclosed in U.S. patent application Ser. No. 12/779,507 filed May 13, 2010 and published as U.S. Patent Application No. 2010/0269287 on Oct. 28, 2010, the contents and teachings of which are incorporated by reference in their entirety.

The vibration detector 106 is constructed and arranged to detect movement of the portable steamer 24. In particular, when the vibration detector 106 detects movement, the vibration detector 106 directs the controller 100 to reset a timer (e.g., an internal counter within the controller 100, a counter external to the controller 100, etc.). As long as the timer does not expire (i.e., as long as the timer does not reach a predetermined time limit such as 30 seconds, one minute, two minutes, five minutes, etc.), the portable steamer 24 remains turned on and the controller 100 continues to provide power to the steam generator 86 as well as direct the pump 84 to operate at the selected pump rate. However, if the timer does expire due to lack of movement detection by the vibration detector 106, the portable steamer 24 automatically turns off and the controller 100 stops operation of the pump 84 and the steam generator 86. Such operation safely turns off the portable steamer 24 after a predefined period of inactivity. Further details will now be provided with reference to FIGS. 8-10.

Figure 8:
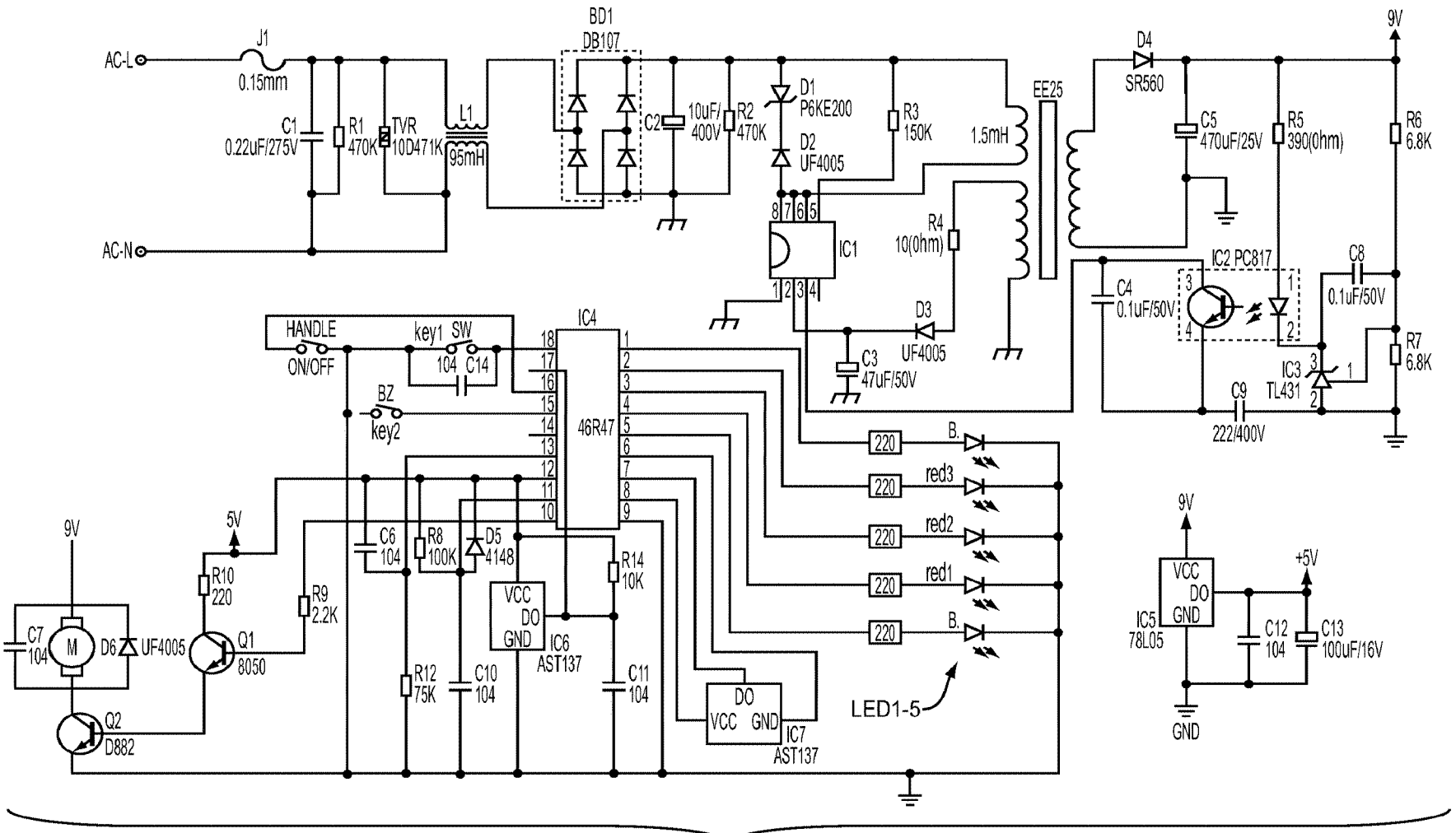
FIG. 8 is a schematic diagram of electronic circuitry of the appliance of FIG. 1 in accordance with an embodiment.
Figure 9:
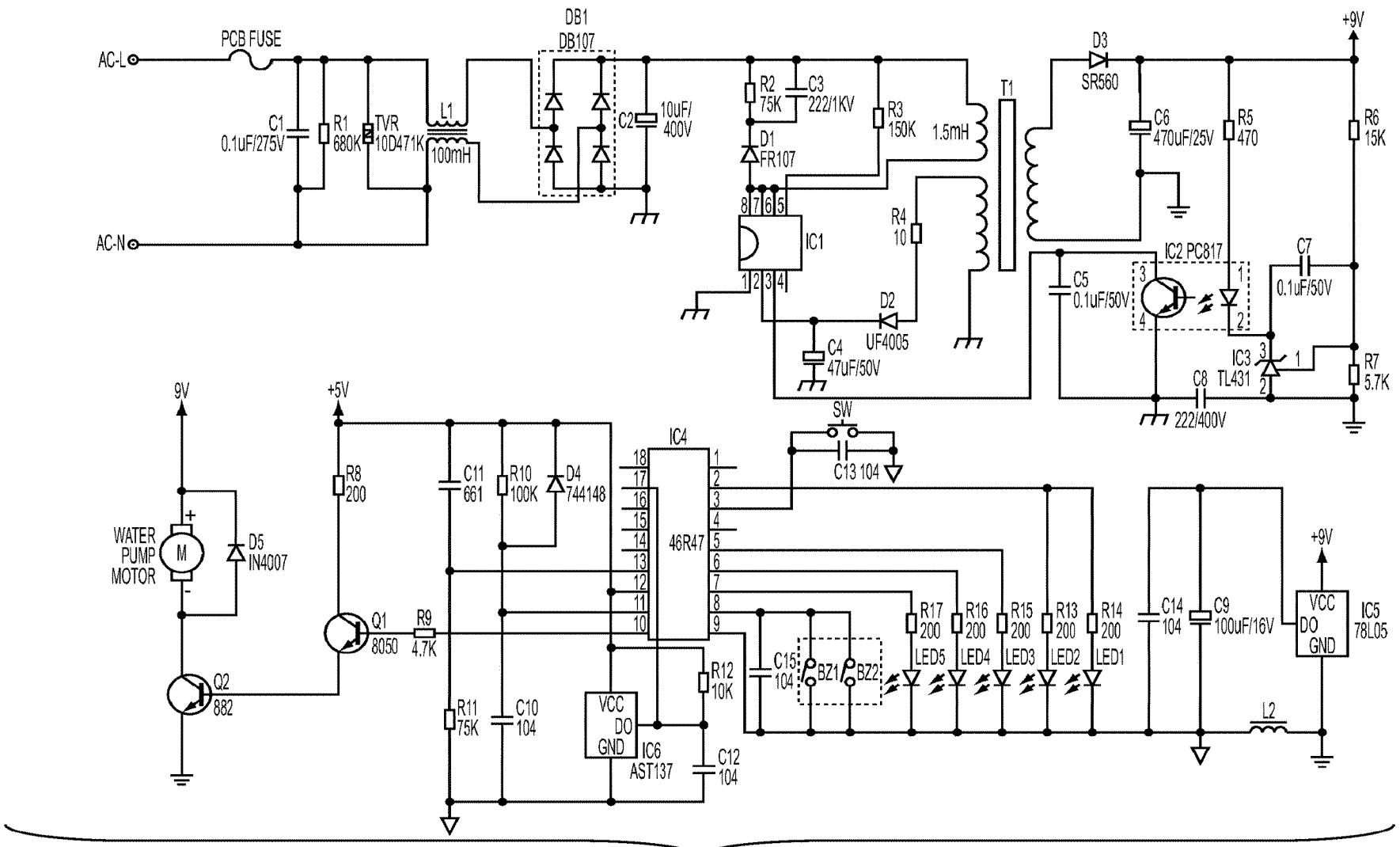
FIG. 9 is a schematic diagram of electronic circuitry of the appliance of FIG. 1 in accordance with another embodiment.
Figure 10:
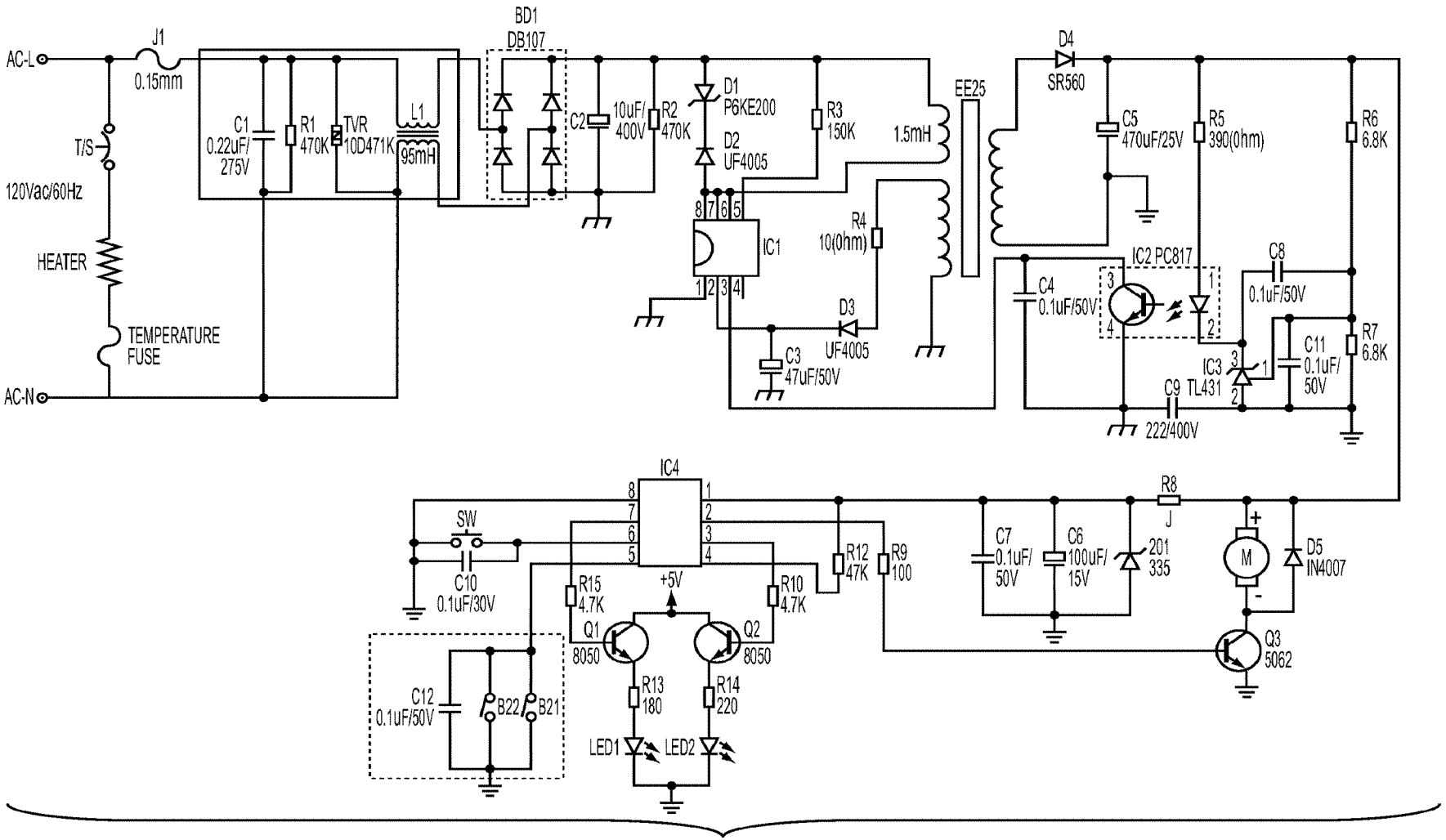
FIG. 10 is a schematic diagram of electronic circuitry of the appliance of FIG. 1 in accordance with yet another embodiment.

FIGS. 8-10 are three different circuit diagrams for providing variable steam to the appliance 20 according to different embodiments. As briefly mentioned earlier, the appliance 20, being in the form of a steam mop 46 or a portable steamer 24, includes a steam generator 86, a tank 82, and a mechanical pump 84 in communication with the steam generator 86 and the pump 84, where the pump 84 can be configured to pump water from the water tank 82 to the steam generator 86 for the generation of steam. The number of strokes being triggered by the mechanical pump 84 and correspondingly the amount of water being pumped from the water tank 82 to the steam generator 86 may be controlled by a control input of the user interface 102 such as a switch which toggles between at least two different pump rates (see switch labeled "SW" in FIG. 8). In these instances, the pump rates may already be predetermined and, by actuating the switch SW, the user simply toggles between the different preset rates. This variable steam feature allows different amounts of steam to be generated and outputted from the outlet section 92 (FIG. 6).

In FIG. 8, IC1, IC2 and IC3, along with adjacent components, form a switching power supply with 9 VDC output. IC4 is an 8-bit single chip microprocessor (also see the controller 100 of the electronic circuitry 88 in FIGS. 6 and 7), which is controlled by the user through the user interface 102 and in turn controls pump speed (i.e., the number of strokes/movements per a particular time period). Once the portable steamer 24 is powered on, switch power supply will provide a 9V DC output and it is stepped down to 5V through IC5. IC7 AST137 Hall Effect sensor may be used to may be used to detect whether the portable steamer housing 80 of the portable steamer 24 is mounted on the main body 30 of the steam appliance device 22 or not (also see sensor 104 in FIGS. 6-7). When the portable steamer housing 80 is coupled to the main body 30, the functions are similar to those as shown in FIG. 9, which will be described in more detail below. Both LEDs (LED1 and LED2) will flash and LED3-5 may be turned off. Pin 10 of IC4 is in low voltage level and Q1 is turned off (pump has no function).

Once the user presses or actuates the switch SW, LED1, LED2 and LED3 will turn on and a microprocessor may generate a PWM (pulse-width modulation) signal to activate Q1. Approximately 4.2V DC will be provided to the mechanical pump (e.g., low steam rate). IC6 AST137 may be used to count the number of movements of the pump 84 (e.g., number of pump strokes) in the time period. Optionally, the microprocessor may adjust the PWM signal to maintain a constant number of movements. In one embodiment, toggling the switch SW may cycle the following functions (e.g., off-low steam rate-medium steam rate-high steam rate).

The table below summarizes the number of movements (e.g., pump strokes) and the start voltage for three different steam rates according to one embodiment. The different start-up voltages drive the speed of the piston within the mechanical pump 84 to deliver the necessary number of strokes or movements (e.g., 6.0V to drive or deliver 72 strokes).

| Steam Rate | Number of Movements or Strokes in the Time Period | Start-Up Voltage |
|---|---|---|
| Low | 40 | 4.2 V |
| Medium | 60 | 5.0 V |
| High | 72 | 6.0 V |

In one embodiment and as briefly mentioned earlier, an internal timer may start count up once the mechanical pump 84 is active, and the microprocessor may turn off the mechanical pump 84 after internal counting has reached 30 seconds. Optionally, one or more vibration sensors BZ may be connected in parallel to increase sensitivity. In some instances, the internal timer may reset when the processor detects a voltage a voltage level change on pin 15 (e.g., from high voltage to low voltage or from low voltage to high voltage). In other instances, the portable steamer 24 may automatically turn-off when no movement has been detected for 30 seconds. For example, the auto-off feature may incorporate a ball-trigger mechanism or barrel-type ball switch. In these instances, the auto-off features works off the movement of the cleaning appliance 10. In one embodiment, when the portable steamer housing 80 is detached from the main body 30, normal operation of the switch SW may be disabled along with the auto-off feature.

In some instances, the low, medium and high steam rates may be correlated to the amount of steam being generated per minute. For example, low steam rate may incorporate a 20% duty cycle to deliver 17 mL/min of steam, medium steam rate may incorporate a 50% duty cycle to deliver 24 mL/min of steam, and high steam rate may incorporate an 80% duty cycle to deliver 28 mL/min of steam. In a 10 second on-off cycle, 20% duty cycle means that the unit may be off for 2 seconds and be on for 8 seconds, and repeat accordingly.

In FIG. 9, IC1, IC2 and IC3, along with adjacent components, form a switching power supply with 9 VDC output. IC4 may be an 8-bit single chip microprocessor which is controlled by the user through the user interface 102 (FIG. 6) and, in turn, controls pump speed. Once the portable steamer 24 is power on, switch power supply may provide a 9V DC output and stepped down to 5V through IC5. Both LED1 and LED2 may flash, LED3-5 may be turned off. Pin 10 of IC4 is in low voltage level and Q1 is turned off (e.g., pump is not active).

Once the user actuates the switch SW, LED1, LED2 and LED3 will turn on and the microprocessor may generate a PWM signal to activate Q1. Approximately 4.2V DC will be provided to the pump (e.g., low steam rate). IC6 AST137 may be used to count the number of movements of the pump (e.g., number of pump strokes) in a particular period. Optionally, the microprocessor may adjust PWM signal to maintain a constant number of movement. In one embodiment, toggling the switch SW may cycle the following functions (e.g., off-low steam rate-medium steam rate-high steam rate).

The table below summarizes the number of movements (e.g., pump strokes) and the start voltage for three different steam rates according to one embodiment. The different start-up voltages drive the speed of the piston within the mechanical pump 84 to deliver the necessary number of strokes or movements (e.g., 6.0V to drive or deliver 72 strokes).

| Steam Rate | Number of Movements or Strokes in Time Period | Start-Up Voltage |
|---|---|---|
| Low | 40 | 4.2 V |
| Medium | 60 | 5.0 V |
| High | 72 | 6.0 V |

In one embodiment, an internal timer may start count up once the mechanical pump 84 is active, and the microprocessor may turn off the mechanical pump after internal counting has reached 30 seconds. Optionally, vibration sensors (BZ1 and BZ2) may be connected in parallel to increase sensitivity. In some instances, the internal timer content may reset when the processor detects a voltage level change on pin 10 (e.g., from high voltage to low voltage or from low voltage to high voltage). In other instances, the portable steamer 24 may automatically turn-off when no movement has been detected for 30 seconds.

In FIG. 10, IC1, IC2 and IC3, along with adjacent components, form a switching power supply with 5.9 VDC output. IC4 may be an 8-bit single chip microprocessor which is controlled by the user through the user interface 102 (FIG. 6) and, in turn, controls pump speed. Once the portable steamer 24 is power on, switch power supply may provide a 5.8V DC output and stepped down to 5V through R8 and ZD1. Both LED1 and LED2 may flash after power up, pin 2 of IC4 may be in low voltage, and IC4 may be in low voltage level and Q3 is turned off (e.g., pump is not active).

Once the user actuates the switch SW, LED1 will turn on and LED2 will turn off. The microprocessor may generate a PWM signal (0.2 ms on and 0.1 ms off) to activate Q3. Approximately 4.4V to 4.5 V DC will be provided to the pump (e.g., low steam rate operation). When the switch SW is actuated again, LED1 will turn off and LED2 will turn on, the microprocessor will generate a high signal to active Q3 and provide approximately 5.7V to 5.8V DC to the pump (e.g., high steam rate). When the switch SW is actuated again, the microprocessor may generate a low voltage signal to turn off Q3. LED's may flash on the light indicator (see LEDs in the user interface 102 of FIG. 6) and the pump 84 may be stopped.

It should be understood that various other circuits are suitable for use to form the electronic circuitry for the steam mop 46. Such circuitry may include ICs, application specific ICs, field programmable gate arrays (FPGAs), microcontrollers and memory, analog circuitry, combinations thereof, and so on.

As mentioned above, an improved steam appliance 20 includes (i) a steam application device 22 which is equipped with a swivel to provide enhanced maneuverability, and a portable steamer 24 which provides steam for use by the steam application device 22 as well as for use in a standalone manner. With such a combination, the user is able to conveniently and effectively clean a variety of surfaces with the portable steamer 24 attached to the steam application device 22 (e.g., tile floors, linoleum, hardwood flooring, etc.) as well as other surfaces with the portable steamer 24 detached from the steam application device 22 (e.g., counter tops, walls, etc.).

While various embodiments of the invention have been particularly shown and described, it will be understood by those skilled in the art that various changes in form and details may be made therein without departing from the spirit and scope of the invention as defined by the appended claims.

What is claimed is:

1. An appliance, comprising:

a steam application device having:

a main body which includes a first end and a second end disposed generally opposite each other, and an inlet section to receive steam, an applicator constructed and arranged to apply the steam to a surface, and a swivel assembly connected to the second end of the main body and constructed and arranged to swivel the applicator and the main body relative to each other; and a portable steamer comprising a first end and a second end disposed generally opposite each other and constructed and arranged to (i) attach to the steam application device and (ii) detach from the steam application device, the portable steamer having:

a steam generator proximate the second end of the portable steamer and constructed and arranged to generate the steam, an outlet section proximate the first end of the portable steamer and constructed and arranged to connect to the inlet section of the main body of the steam application device when the portable steamer is attached to the steam application device, the outlet section being constructed and arranged to provide the steam from the steam generator to the inlet section of the main body of the steam application device when the portable steamer is attached to the steam application device;

an electric pump constructed and arranged to selectively provide the steam a different pumping rates, and a user interface constructed and arranged to receive user input and select one of the different pumping rates in response to the user input;

wherein when the portable steamer is attached to the steam application device, the first end of the main body of the steam application device is more proximate to the first end of the portable steamer than to the second end of the portable steamer, and the second end of the main body of the steam application device is more proximate to the second end of the portable steamer than to the first end of the portable steamer.

2. An appliance as in claim 1 wherein the steam application device further has a mop handle;

wherein the first end of the main body connects to the mop handle;

wherein the second end of the main body connects to the swivel assembly; and wherein the mop handle, the main body, the swivel assembly and the applicator are disposed substantially in an inline configuration which forms a mop through which a user, when holding the mop handle, is able to mop the surface with the applicator.

3. An appliance as in claim 2 wherein the main body defines a cavity to cradle the portable steamer when the portable steamer attaches to the steam application device.

4. An appliance as in claim 3 wherein the steam generator further has:

a tank to hold water, the outlet section of the steam generator and the inlet section of the steam application device being disposed between the mop handle and the tank when the portable steamer is cradled in the cavity.

5. An appliance as in claim 3 wherein the mop handle and the swivel assembly define a center axis of the mop; and wherein the main body is C-shaped, the center axis of the mop passing through the cavity defined by the main body.

6. An appliance as in claim 5 wherein the swivel assembly includes:

a first set of hinges to control height of the mop handle when the user mops the surface with the applicator; and a second set of hinges to control left and right angular deflection of the applicator when the user mops the surface with the applicator.

7. An appliance as in claim 6 wherein the first set of hinges defines a first pivot axis;

wherein the second set of hinges defines a second pivot axis; and wherein the first pivot axis is substantially perpendicular to the second pivot axis to enable the user to impart rotation to the applicator while concurrently moving the mop handle forward and backward to mop the surface with the applicator.

8. An appliance as in claim 2 wherein the portable steamer further has:

a portable steamer handle coupled to the steam generator and the outlet section, the portable steamer handle being constructed and arranged to be held by a user when the portable steamer is detached from the steam application device to provide the steam from the steam generator in a manner which is independent of the mop formed by the mop handle, the main body, the swivel assembly and the applicator.

9. An appliance as in claim 8 wherein the portable steamer further has:

a sensor constructed and arranged to provide an electronic signal having a first value when the portable steamer is attached to the steam application device, and a second value which is different than the first value when the portable steamer is detached from the steam application device.

10. An appliance as in claim 9 wherein the portable steamer further has:

a trigger disposed along the portable steamer handle, wherein actuation of the trigger is ignored by the steam generator when the electronic signal has the first value, and wherein actuation of the trigger causes release of the steam from the steam generator through the outlet section when the electronic signal has the second value.

11. An appliance as in claim 10 wherein the sensor is a Hall effect sensor to enable detection of whether the portable steamer is attached to or detached from the steam application device in the absence of electrical continuity with the steam application device.

12. An appliance as in claim 8 wherein the portable steamer further has:

a set of depressible buttons to control unlocking of the portable steamer from the steam application device when the portable steamer is attached to the steam application device.

13. An appliance as in claim 1 wherein the user interface is further constructed and arranged to provide different lighted outputs depending on which of the different pump rates is selected by the user input.

14. An appliance as in claim 1 wherein the steam generator of the portable steamer further includes:

a vibration detector constructed and arranged to detect movement of the portable steamer, and a controller coupled to the vibration detector, the controller being constructed and arranged to: (i) reset a timer in response to each movement detected vibration detector, and (ii) turn the steam generator off when the timer reaches a predetermined time limit.

15. An appliance, comprising:

a steam application device having:

a main body which includes a first end and a second end disposed generally opposite each other, and an inlet section to receive steam;

an applicator constructed and arranged to apply the steam to a surface;

a swivel assembly connected to the second end of the main body and constructed and arranged to swivel the applicator and the main body relative to each other; and a mop handle, wherein the first end of the main body connects to the mop handle, the second end of the main body connects to the swivel assembly, and the mop handle, the main body, the swivel assembly and the applicator are disposed substantially in an inline configuration which forms a mop through which a user, when holding the mop handle, is able to mop the surface with the applicator; and a portable steamer comprising a first end and a second end disposed generally opposite each other and constructed and arranged to (i) attach to the steam application device and (ii) detach from the steam application device, the portable steamer having:

a steam generator proximate the second end of the portable steamer and constructed and arranged to generate the steam, an outlet section proximate the first end of the portable steamer and constructed and arranged to connect to the inlet section of the main body of the steam application device when the portable steamer is attached to the steam application device, the outlet section being constructed and arranged to provide the steam from the steam generator to the inlet section of the main body of the steam application device when the portable steamer is attached to the steam application device;

a portable steamer handle coupled to the steam generator and the outlet section, the portable steamer handle being constructed and arranged to be held by a user when the portable steamer is detached from the steam application device to provide the steam from the steam generator in a manner which is independent of the mop formed by the mop handle, the main body, the swivel assembly and the applicator; and a set of depressible buttons to control unlocking of the portable steamer from the steam application device when the portable steamer is attached to the steam application device;

wherein when the portable steamer is attached to the steam application device, the first end of the main body of the steam application device is more proximate to the first end of the portable steamer than to the second end of the portable steamer, and the second end of the main body of the steam application device is more proximate to the second end of the portable steamer than to the first end of the portable steamer.

16. An appliance, comprising:

a steam application device having:

a main body which includes a first end and a second end disposed generally opposite each other, and an inlet section to receive steam;

an applicator constructed and arranged to apply the steam to a surface;

a swivel assembly connected to the second end of the main body and constructed and arranged to swivel the applicator and the main body relative to each other; and a mop handle, wherein the first end of the main body connects to the mop handle, the second end of the main body connects to the swivel assembly, and the mop handle, the main body, the swivel assembly and the applicator are disposed substantially in an inline configuration which forms a mop through which a user, when holding the mop handle, is able to mop the surface with the applicator; and a portable steamer comprising a first end and a second end disposed generally opposite each other and constructed and arranged to (i) attach to the steam application device and (ii) detach from the steam application device, the portable steamer having:

a steam generator proximate the second end of the portable steamer and constructed and arranged to generate the steam, an outlet section proximate the first end of the portable steamer and constructed and arranged to connect to the inlet section of the main body of the steam application device when the portable steamer is attached to the steam application device, the outlet section being constructed and arranged to provide the steam from the steam generator to the inlet section of the main body of the steam application device when the portable steamer is attached to the steam application device;

a portable steamer handle coupled to the steam generator and the outlet section, the portable steamer handle being constructed and arranged to be held by a user when the portable steamer is detached from the steam application device to provide the steam from the steam generator in a manner which is independent of the mop formed by the mop handle, the main body, the swivel assembly and the applicator;

a sensor constructed and arranged to provide an electronic signal having a first value when the portable steamer is attached to the steam application device, and a second value which is different than the first value when the portable steamer is detached from the steam application device; and a trigger disposed along the portable steamer handle, wherein actuation of the trigger is ignored by the steam generator when the electronic signal has the first value, and wherein actuation of the trigger causes release of the steam from the steam generator through the outlet section when the electronic signal has the second value;

wherein when the portable steamer is attached to the steam application device, the first end of the main body of the steam application device is more proximate to the first end of the portable steamer than to the second end of the portable steamer, and the second end of the main body of the steam application device is more proximate to the second end of the portable steamer than to the first end of the portable steamer.

17. An appliance as in claim 16 wherein the sensor is a Hall effect sensor to enable detection of whether the portable steamer is attached to or detached from the steam application device in the absence of electrical continuity with the steam application device.

* * * * *